United States Patent [19]

Stewart, Jr. et al.

[11] Patent Number: 4,948,521

[45] Date of Patent: Aug. 14, 1990

[54] METALWORKING COMPOSITION

[75] Inventors: John F. Stewart, Jr., Opelika; Michael L. Griffin, Valley, both of Ala.

[73] Assignee: Cut-N-Clean Products, Inc., Opelika, Ala.

[21] Appl. No.: 385,065

[22] Filed: Jul. 26, 1989

[51] Int. Cl.[5] ..... C10M 173/00

[52] U.S. Cl. ..... 252/28; 252/33; 252/49.5; 252/49.9; 252/56 R; 72/42

[58] Field of Search ..... 252/49.5, 49.3, 28

[56] References Cited

U.S. PATENT DOCUMENTS

| | | | |
|---|---|---|---|
| 4,073,412 | 2/1978 | Doumani | 222/192 |
| 4,088,585 | 5/1978 | Karpen | 252/28 |
| 4,115,282 | 9/1978 | Grasshoff | 252/18 |
| 4,401,579 | 8/1983 | Kratzer | 252/17 |
| 4,409,113 | 10/1983 | Bertell | 252/42 |
| 4,486,324 | 12/1984 | Korosec | 252/49.3 |
| 4,493,777 | 1/1985 | Snyder et al. | 252/49.3 |
| 4,643,837 | 2/1987 | Zimzik | 252/49.5 |

*Primary Examiner*—William R. Dixon, Jr.
*Assistant Examiner*—Ellen M. McAvoy
*Attorney, Agent, or Firm*—Richard C. Litman

[57] ABSTRACT

A metalworking composition in the form of a stable emulsion having lubricating as well as cleaning properties which is based essentially on non-hazardous components. The composition comprises a homogenous mixture of water, a vegetable oil, a phosphatide, a thickening agent and an emulsifying system consisting of an anionic surfactant and a nonionic biodegradable detergent. The emulsion-type mixture can be prepared through sequential addition of the non-hazardous components followed by homogenization in a high-speed mixture. A concentrated lubricant is thereby obtained which readily forms an adhering film on the surface of a metallic workpiece and all types of metalworking mediums during machining operations to effectively prevent galling or fouling. The metalworking composition is environmentally safe and significantly reduces problems associated with cleanup and corrosion.

13 Claims, No Drawings

METALWORKING COMPOSITION

BACKGROUND OF THE INVENTION

1. Field of the Invention

This invention relates to a metalworking composition having lubricating and cleaning properties and a method for preparing the same. More particularly, the invention relates to water-based lubricants containing non-hazardous components for use as metalworking fluids.

2. Description of the Prior Art

The prior art has proposed numerous water-based metalworking fluids intended for use where a lubricant is required to be in contact with a metal surface as it is worked mechanically. For such machining operations as metal cutting, milling, grinding and the like, it has been proposed to use metalworking fluids in the form of water-containing emulsions based on mineral products and additives to improve lubrication, as more fully described in U.S. Pat. Nos. 3,249,538 and 3,933,658. While these water-in-mineral oil, emulsion-type metalworking fluids are generally economical to produce, the mineral oil component of these fluids produce oil smoke and mist at elevated temperatures to create environmentally unsafe conditions for the worker. Moreover, mineral oils also form certain polyaromatic hydrocarbons which have been recently recognized as being carcinogenic substances.

In recent years increased concern for industrial safety has created environmental control legislation in the United States which imposes strict requirements on the type of metalworking fluids that may be used in the industry. To fulfill the requirements of the fluids from environmental aspects, the metalworking art has reverted to the use of fatty oils, i.e. vegetable and animal oils and fats, which were used extensively as suitable raw materials for lubricants before the cheaper mineral oils came to dominate the market. Fatty oils can be completely broken down biologically and do not present the health and environmental problems associated with mineral oils.

A metalworking emulsion of the oil-in-water type based on triglyceride oils is disclosed in U.S. Pat. No. 4,237,021. The emulsifying agent used consists of fatty acid monoglycerides and alkali soaps of fatty acids. To increase the lubricating properties of the disclosed emulsions, it is generally necessary to add fatty acids and an alkanolamine or fatty amine. However, because of the acidic properties of fatty acids, undesirable problems appear. It has been found that early sludge is often formed and certain metal alloy bearing surfaces are readily corroded by oxidation and polymerization when employing emulsions of this type.

It is accordingly a primary object of the present invention to provide an improved metalworking composition in the form of an oil-in-water emulsion having excellent lubricating properties and comprising essentially harmless components from environmental and health aspects.

It is a further object of the invention to provide a method for preparing homogenized metalworking emulsions of the oil-in-water type which are sufficiently stable on storage and capable of maintaining their viscosities under variable conditions.

It is among the additional objects of the present invention to provide water-containing metalworking compositions which have good heat resistance and relatively good cooling and cleaning properties, which do not require the addition of numerous additives, can be readily disposed of when spent to facilitate convenient waste treatment, can be easily applied to form an adhering film on the surface of a metallic workpiece, and which prevent problems associated with acidic impurities such as corrosion, oxidation and polymerization.

Other objects and advantages of the present invention will become apparent from the following general description.

SUMMARY OF THE INVENTION

These and other objects are accomplished in accordance with the present invention wherein an improved metalworking composition in the form of an emulsion is provided comprising a homogenous mixture of water, a vegetable oil substantially free of fatty acids, a phosphatide selected from the group consisting of lecithin and cephalin, a thickening agent, and an emulsifying system consisting of an anionic surfactant and a nonionic detergent.

In general, the water-containing metalworking compositions of the invention are prepared by dissolving the phosphatide in the vegetable oil at an elevated temperature to produce an oil solution. Water is added to the oil solution and the resulting dispersion is cooled to ambient temperatures. The nonionic component of the emulsifying system is then added to the dispersion and the viscosity of the resulting emulsion is adjusted by the controlled addition of the thickener. After a suitable period of time, the anionic surfactant is incorporated into the emulsion under turbulent agitation to obtain a concentrated liquid lubricant having a good emulsion stability and improved consistency.

It has been found that the metalworking compositions of the present invention are more similar to mineral oils in their rheological properties, without having their detrimental effects on the metal worker and the environment. The emulsifying system employed in the invention consists of safe components and is uncomplicated in composition. Also, the invention contemplates compositions containing coloring agents, scents and preservatives homogeneously dispersed throughout the novel emulsions. However, these additives are used in minimum amounts and do not influence the lubricating properties of the present metalworking compositions.

The above description, as well as further objects, features and advantages of the present invention, will be more fully appreciated by reference to the following detailed description.

DETAILED DESCRIPTION OF THE INVENTION

Accordingly, the present invention provides a metalworking composition in the form of an emulsion comprising a homgenous mixture containing:

- 30–40 percent by weight of water,
- 30–40 percent by weight of a vegvetable oil substantially free of fatty acids,
- 1–5 percent by weight of a phosphatide selected from the group consisting of lecithin and cephalin,
- 0.5–3 percent by weight of a thickening agent, and
- 20–30 percent by weight of an emulsifying system consisting of an anionic surfactant and a nonionic detergent.

The vegetable oil may be of the so called "edible" type used in food preparation and, preferably, should be substantially free of fatty acids, i.e., have a fatty acid content of less than 0.20% based on the total weight of the vegetable oil used. Suitable oils, from a functional aspect, include olive oil, cottonseed oil, soybean oil, peanut oil, corn oil and safflower oil. Corn oil which has been specifically refined to provide the prerequisite characteristics for use in the compositions of the present invention has been found particularly preferred for this purpose.

The incorporation of a relatively small amount of the phosphatide such as lecithin or cephalin has been demonstrated to promote the stabilization of the present compositions substantially. The phosphatides belong to the class of compounds having the following general formula:

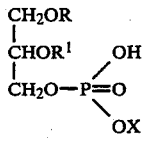

wherein R and $R^1$ are similar or dissimilar fatty acid radicals such as those derived from stearic, palmitic or oleic, and in the case of lecithin X represents a choline group of the formula:

$$-CH_2CH_2N(CH_3)_3OH$$

and in the case of cephaline X represents the colamine group:

$$-CH_2CH_2NH_2$$

The preferred phosphatides useful in the invention is lecithin, especially, granular lecithin from soybeans which is essentially oil-free and colloidally soluble in water.

The thickening agent utilized to substantially increase the viscosity and improve the consistency of the metalworking compositions of the invention may be a silica thickener. The preferred silica thickener is amorphous silicon dioxide which is obtained as a fine white, odorless power and which forms a colloidal fluid in solution.

The emulsifying system which is employed in accordance with the present invention in conjunction with the above described components consists of a combination of an anionic surfactant and a nonionic detergent. The term "nonionic detergent" is used herein to denote a liquid cleaning agent having biodegradable properties and containing polar covalent structures which provide the appropriate hydrophobic-hydrophilic balance for the desired solubility. The nonionic detergent is preferably composed of an alkylbenzene sulfonate, a diethanolamide and an ethoxylated alcohol, which are blended in a ratio to provide the maximum cleaning efficiency. The ethoxylated alcohol is generally prepared by condensing ethylene oxide with an alkyl phenol. The optimum amount of ethylene oxide for the attainment of the desired hydrophobic-hydrophilic balance can be readily determined in any particular detergent formulation by routine experimentation. Examples of suitable alkyl phenol condensation reactants include nonyl phenol, dinonyl phenol and dodecyl phenol and mixtures thereof. The alkyl group of the alkylbenzene sulfonate component is preferable linear and has about 4 to about 20 carbon atoms.

In addition to the alkylbenzene sulfonate and ethoxylated alcohol components, the preferred nonionic detergent formulations contain a diethanolamide of the formula:

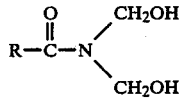

wherein R is an aliphatic radical of about 8 to about 54 carbon atoms or a residue based on fatty raw materials.

The diethanolamides are known compositions in the prior art and are generally prepared by esterifying a diethanolamine with an aliphatic carboxylic acid. Useful carboxylic acids include branched or straight chain saturated or unsaturated monocarboxylic or dicarboxylic acids. It is also possible to use vegetable oils containing free fatty acids as the base material for the preparation of the diethanolamide component. Especially suitable is a coconut oil-based diethanolamide and the most preferred nonionic detergent useful in the metalworking composition of the invention are commercial mixtures of alkylbenzene sulfonate/coconut-oil based diethanolamide/ethoxylated concentrate formulations sold under the trademark "Witcodet 100" by Witco Chemical Corporation. These nonionic detergent formulations in aqueous solution are completely stable under neutral and alkaline conditions and show little tendency to hydrolkyze or decompose on storage. Moreover, incorporated in the emulsion compositions of the present invention, the nonionic components exhibit excellent metal cleaning properties.

The anionic surfactant may be suitably a sulfate of a fatty acid or sulfonate salt of an alkylbenzene or alkylphenoxy compound, wherein the alkyl groups thereof have about 4 to about 20 carbon atoms and the fatty acid is derived from a saturated straight chain acid containing from about 8 to 18 carbon atoms. A preferred anionic surfactant is an ammonium salt of sulfated alkylphenoxypolyethylene glycol, commercially available and sold under the trademark "Mazon 41" by Mazer Chemicals.

The proportion of nonionic detergent to anionic surfactant is about 4.5:1 to about 7:1, preferably about 5:1 to about 6:1, based upon the total weight of the emulsifying system. Generally, the metalworking compositions of the invention are prepared in ready-to-use concentrations containing up to about 40 percent by weight water with the total proportion of vegetable oil, phosphatide, thickener and emulsifying system being less than 60 percent by weight, and the balance being made by such additives as coloring agents, scents and preservatives. Surprisingly, the addition of corrosion inhibitors, chelating agents or additives to increase the lubricity of the present compositions are not required.

A preservative for preventing the deterioration of liquid lubricants can be added to the metalworking compositions of the invention, which may be subject to attack by micro-organisms from the workplace environment. A especially useful preservative for avoiding this condition is diiodomethyl p-tolylsulfone, which has been approved for use in food contact applications. It is preferable to use less than 0.02 parts by weight of the preservative per 100 parts by weight of the present compositions. Also, olfactory agents, such as peppermint oil terpenes, may be used to mask any unpleasant odors that may develop as a result of attack by microorganisms or merely to add a pleasant scent to the present compositions. Usually, less than 0.02 parts by weight of these particular agents per 100 parts by weight of the compositions of the present invention can be effectively used for this purpose. A synthetic dye may be additionally incorporated into the metalworking composition to not merely enhance its esthetic appearance, but to allow it to be clearly visible during metalworking operations.

The present emulsion-type, liquid compositions may have a viscosity in the range of about 2000 to 4000 cps at 25° C., but are not limited to this general range. The viscosity of the lubricant compositions can be readily adjusted during formulated to suit the various applications. The concentrated compositions of the present invention can be put into use without dilution or wetting the surface of a metallic workpiece or a metalworking tool for low volume applications and can have the lubricating effect of preventing the tool and workpiece from their direct contact during such machining operations as drilling, turning, milling, tapping, metal cutting and grinding. The present lubricant compositions may be applied by spraying, brushing, roll coating, etc., whereby the concentrated compositions tightly adhere mostly to the surface of the metallic workpiece to readily form a dense lubricating film on the surface thereof without dripping or running off. Thus, the occurrence of fouling or galling on the surface of a metallic workpiece is significantly reduced and the durability or useful life of all types of metalworking media, including dies, grinding disks, as well as belts, etc., can be expected to be considerably prolonged.

The present invention also provides a process for preparing an emulsion type, lubricant composition having good dispersion stability, where the stability of the resulting emulsion concentrate can be much improved by homogenization in a conventional high speed mixer or homogenizer. Generally, the oil-in-water dispersion of water and the oil solution containing the vegetable oil and the phosphatide is first prepared and the nonionic detergent component of the emulsifying system is then added to the dispersion to form a rather liquid-type emulsion. The dry powdered thickener, which is insoluble in water, is slowly added with mixing to the liquid emulsion to produce a viscous concentrated emulsion. A coloring agent, preferably an artificial dye for use in food applications, and any optional additives such as an olfactory agent and a preservative is then added with continuous mixing and the anionic surfactant is subsequently incorporated into the resulting emulsion under turbulent mixing conditions to prepare a homogenized composition according to the present invention of uniform consistency.

The good stability of the emulsion state of the present metalworking composition is important from a practical aspect. Generally, the phase separation of the compositions of the present invention is suppressed with the specific emulsifying system described above. Above, stabilization of the present compositions are improved by means of homogenization in accordance with the method of the present invention, wherein mutually insoluble ingredients are sequentially combined and uniformly mixed under specific conditions.

The metalworking compositions produced by the method of the present invention possess not only excellent lubricating properties, but also have good cleaning ability. Thus, the present compositions serve as metal cleaners and/or polishers which remove residue or coatings from surfaces of a metallic workpiece, especially non-ferrous alloys as aluminum, without adversely effecting the viscosity or lubricity of the metalworking compositions of the present invention during machining operations.

The following examples further illustrate the various aspects of the invention but are not intended to be construed as limiting in any way. All parts, proportions, and percentages are by weight and all temperatures are in degrees Centigrade unless otherwise stated.

EXAMPLE 1

Added to 33.2 parts by weight of corn oil having a free fatty acid content of less than 0.05% with stirring was 3.6 parts by weight of granular soybean lecithin and the oil solution was heated to 60° C. until dissolution was complete. Then, 35.6 parts by weight of water added thereto with mild agitation to form an oil-in-water dispersion. The dispersion was cooled to room temperature (25° to 27° C.) and 22 parts by weight of a nonionic biodegradable detergent composed of alkylbenzene sulfonate, coconut oil-based diethanolamide and ethoxylated alcohol (Witcodet 100, made by Witco Chemical Corporation) was added to form a liquid emulsion. Slowly mixed with the liquid emulsion was 1.2 parts by weight of silicon dioxide (amorphous) and mixing continued by stirring for a period of 1 hour and 15 minutes until a thickened emulsion was obtained. Thereafter, 4.3 parts by weight of an ammonium salt of sulfated alkylphenoxypolyethylene glycol (Mazon 41, made by Mazer Chemicals) was added to the emulsion and the resulting mixture was stirred in a homogenizer, whereby an emulsified liquid lubricant was obtained.

A portion of the above obtained liquid lubricant was placed in 50 ml sample tubes and left standing at room temperature to evaluate the emulsion stability. After 10 days, no visible change, as far as the occurrence to phase separation, in any of the samples could be detected. Furthermore, an aluminum workpiece is dipped into a portion of the above obtained liquid lubricant heated to 60° C. for 1 minute, whereby a dense film having an excellent lubricating effect on the metallic workpiece is readily formed.

EXAMPLE 2

The method described in Example 1 was repeated, except that after the thickened emulsion was obtained by the addition of the silicon dioxide and mixing period completed, 1.5 gms of a food grade blue dye and 354 gms of diiodomethyl-p-tolylsulfone was added with continuous stirring. The resulting composition after homogenization had a general consistency comparable to that of Example 1. However, the color achieved in Example 2 was noticeably greenish in comparison to the yellowish appearance of the liquid lubricant of Example 1. In addition, the overall stability, lubricity and film forming properties of the end composition were comparatively identical to those achieved in Example 1.

EXAMPLE 3

The method described in Example 2 was repeated, except that 400 gms of peppermint oil terpenes was added after the thickened emulsion was obtained. This olfactory ingredient constitutes about 0.1 percent by weight of the total composition. The end product possesses physical characteristics very much the same as those exhibited by the composition of Example 2, noticeably differing only in scent. The instant product provided a pleasant fragrance in comparison with the slightly disagreeable odor detected in the compositions of Examples 1 and 2.

The metalworking compositions prepared in accordance with the method of the present invention were evaluated for performance in a milling machine by cutting aluminum. It was found that present compositions readily formed a lubricating film on the surfaces of the metalworking media and provided quick cutting of the aluminum with no loading of the milling cutter. Cleanup of all workpieces was easily accomplished with plain tap water.

While the invention has been described with reference to certain specific embodiments, it will be recognized by those skilled in the art that various modifications are possible without departing from the scope and spirit of the invention.

We claim:

1. A metalworking composition in the form of a stable emulsion comprising a homogenous mixture of:

30–40 percent by weight of water,

30–40 percent by weight of a vegetable oil having a fatty acid content of less than 0.20% by weight, 1–5 percent by weight of a phosphatide selected from the group consisting of lecithin and cephalin, 0.5–3 percent by weight of a silica thickening agent, and 20–30 percent by weight of an emulsifying system comprising an anionic surfactant and a nonionic detergent, wherein said anionic surfactant is selected from the group consisting of a sulfate of a fatty acid, a sulfonate salt of an alkylbenzene and a sulfonate salt of an alkylphenoxy compound having about 4 to about 20 carbon atoms in the alkyl groups thereof, and wherein said nonionic detergent consists of an alkylbenzene sulfonate having about 4 to about 20 carbon atoms in the alkyl group thereof, a diethanolamide and an ethoxylated alcohol.

2. The metalworking composition according to claim 1 wherein said vegetable oil is selected from the group consisting of olive oil, cottonseed oil, soybean oil, peanut oil, corn oil and safflower oil.

3. The metalworking composition according to claim 2 wherein said vegetabe oil is corn oil.

4. The metalworking composition according to claim 1 wherein said phosphatide is lecithin.

5. The metalworking composition according to claim 4 wherein said lecithin is granular soybean lecithin.

6. The metalworking composition according to claim 2 wherein said thickening agent is amorphous silicon dioxide.

7. The metalworking composition according to claim 1 wherein said sulfonate salt of an alkylphenoxy compound is an ammonium salt of sulfated alkylphenoxypolyethylene glycol.

8. The metalworking composition according to claim 1 wherein said diethanolamide is derived from the esterification of an aliphatic carboxylic acid or a vegetable oil containing free fatty acids with diethanolamine.

9. The metalworking composition according to claim 1 wherein said diethanolamide is a coconut oil-based diethanolamide.

10. The metalworking composition according to claim 1 wherein said homogenous mixture contains up to about 40 percent by weight water with the total proportion of the vegetable oil, phosphatide, thickening agent and the emulsifying system being less than 60 percent by weight, and the balance being made by minor amounts of an additive selected from the group consisting of a coloring agent, an olfactory agent, a preservative and mixtures thereof.

11. The metalworking composition according to claim 10 wherein said olfactory agent is peppermint oil terpenes.

12. The metalworking composition according to claim 10 wherein said preservative is diiodomethyl-p-tolylsulfone.

13. The metalworking composition according to claim 10 wherein said coloring agent is a food grade synthetic dye.

* * * * *